US005690087A

United States Patent [19]

Schumacher et al.

[11] Patent Number: 5,690,087

[45] Date of Patent: Nov. 25, 1997

[54] EGO BASED ADAPTIVE TRANSIENT FUEL COMPENSATION FOR A SPARK IGNITED ENGINE

[75] Inventors: Darren A. Schumacher, Ypsilanti; Kevin J. Bush, Northville, both of Mich.

[73] Assignee: Motorola Inc., Schaumburg, Ill.

[21] Appl. No.: 713,914

[22] Filed: Sep. 13, 1996

[51] Int. Cl.[6] ..... F02D 41/14

[52] U.S. Cl. ..... 123/675

[58] Field of Search ..... 123/674, 675, 123/687, 689, 492, 493

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,481,928 | 11/1984 | Takimoto et al. | 123/492 |
| 4,934,328 | 6/1990 | Ishii et al. | 123/675 |
| 4,939,658 | 7/1990 | Sekozawa et al. | 364/431.06 |
| 4,999,781 | 3/1991 | Holl et al. | 123/674 |
| 5,065,728 | 11/1991 | Nakaniwa | 123/689 |
| 5,144,933 | 9/1992 | Nakaniwa | 13/675 |
| 5,239,974 | 8/1993 | Ebinger et al. | 123/675 |
| 5,265,581 | 11/1993 | Nagaishi | 123/675 |
| 5,271,374 | 12/1993 | Nagaishi et al. | 123/675 |
| 5,448,978 | 9/1995 | Hasegawa et al. | 123/480 |
| 5,474,052 | 12/1995 | Aquino et al. | 123/675 |

FOREIGN PATENT DOCUMENTS 0 152 109 A2 8/1985 European Pat. Off. .

OTHER PUBLICATIONS

"Real Time Engine Control Using STR in Feedback System" by Maki, Akazaki, Hasegawa, Komoriya, Nishimura and Hirota, (no date provided).

"Adaptive Air–Fuel Ratio Control of a Spark–Ignited Engine" by Aault, Jones, Powell and Franklin (no date provided).

"An Adaptive Fuel Injection Control with Internal Model in Automotive Engines" by Inagaki, Ohata and Inoue (no date provided).

"Adaptive Compensation of Fuel Dynamics in an SI Engine Using a Switching EGO Sensor" by P. E. Moraal, Ford Research Laboratories (no date given).

*Primary Examiner*—Willis R. Wolfe
*Attorney, Agent, or Firm*—Nicholas C. Hopman

[57] ABSTRACT

A method and system for adaptive transient fuel compensation in a cylinder of an engine (300) estimates a fraction of fuel evaporated in a fuel intake system of the engine ($\hat{b}_v$) by measuring a temporal delay (515) between when an identification fuel charge is injected (505) and when a binary-type exhaust gas oxygen sensor (315) switches state. An estimate of a fraction of fuel adhering to the fuel intake system of the engine ($\hat{c}$) is derived from the estimate of evaporation wall-wetting parameter ($b_v$). Fuel delivery to the engine is adjusted dependent on the estimates of the adhering wall-wetting parameter (c) and the evaporation wall-wetting parameter ($b_v$).

17 Claims, 3 Drawing Sheets

$m_f$: FUEL FILM MASS
$m_{dep}$: FUEL MASS DEPOSITED IN FILM
$m_v$: FUEL VAPOR FROM FILM
$m_i$: FUEL MASS INJECTED
$m_c$: FUEL MASS ENTERING CYLINDER
c: FUEL FRACTION PARAMETER
$b_v$: FUEL FILM VAPORIZATION PARAMETER
k: ENGINE CYCLE INDEX $$m_f(k) = m_f(k-1) + m_{dep}(k) - m_v(k)$$
$$m_{dep}(k) = cm_i(k)$$
$$m_v(k+1) = b_v m_f(k)$$
$$m_c(k) = (1-c)m_i(k) + m_v(k)$$

EGO BASED ADAPTIVE TRANSIENT FUEL COMPENSATION FOR A SPARK IGNITED ENGINE

FIELD OF THE INVENTION

This invention is generally directed to the field of engine control, and specifically for control of air/fuel ratio in a spark ignited engine by adaptively adjusting fuel delivery dependent on a measurement of certain fuel delivery system dynamic behavior.

BACKGROUND OF THE INVENTION

In order to reduce automotive emissions in an internal combustion engine, precise control of the air/fuel ratio is necessary. This is complicated by the deposit of fuel on the walls of the intake manifold and on the intake valves (wall-wetting). Wall-wetting dynamics has been characterized by two parameters corresponding to a fraction of the injected fuel which is deposited on the walls of the intake manifold, and a fraction of fuel evaporating off of the intake manifold walls. These parameters vary with engine operating condition, engine age, and fuel volatility, making it difficult to compensate for wall-wetting with a non-adaptive controller. Furthermore, during nontrivial transients, the wall-wetting parameters may vary rapidly with rapidly varying operating conditions, resulting in increased emissions because of deviations in air/fuel ratio away from stoichiometry. Therefore, it is desirable to identify these wall-wetting parameters on line and on a cycle-by-cycle basis, which permits a self-tuning control system to use this information to properly compensate the wall-wetting dynamics. State of the an adaptive controllers accomplish this task by utilizing a UEGO (Universal Exhaust Gas Oxygen) sensor, which provides an accurate estimate of air/fuel ratio. The UEGO sensor provides a signal indicative of a magnitude of oxygen in the exhaust gas stream, and has a principally linear response to varying concentration of oxygen. The UEGO sensor, however, is significantly more complex and expensive than the current industry standard EGO (Exhaust Gas Oxygen) sensor. The EGO sensor is a binary-type sensor that only provides information as to whether or not the exhaust is rich or lean, and not the magnitude of the control error as in the case of the UEGO sensor. So, an EGO sensor can not be reasonably used in a transient fuel compensation control system designed to accommodate a UEGO sensor.

Current EGO based adaptive fuel control schemes are computationally intensive and do not achieve adaptation over time periods shorter than several FTP (Federal Test Procedure) test cycles. Furthermore, current EGO based adaptive fuel control schemes do not adapt to varying wall-wetting without waiting for an emissions-increasing transient error to occur.

Therefore, what is needed is an adaptive wall-wetting compensation scheme using an EGO sensor to compensate fuel that is both computationally simple and can operate on an engine cycle-by-cycle basis. An EGO adaptive scheme should also adapt to varying wall-wetting dynamics without waiting for large excursions in the normalized fuel/air ratio before adjusting fuel delivery.

DETAILED DESCRIPTION OF THE PREFERRED EMBODIMENT

A method and system for adaptive transient fuel compensation in a cylinder of an engine estimates fuel puddle dynamics for the cylinder by determining parameters of a wall-wetting model every engine cycle of the engine by measuring a temporal delay between when an identification fuel charge is injected and when a binary-type exhaust gas oxygen sensor switches state. The temporal delay is translated to a fuel evaporation variable that behaves as a function of fuel evaporated. Then, a fuel adhering variable, which represents an amount of fuel adhering to the walls of the engine's intake system is calculated from the determined fuel evaporation variable. Fuel delivery to the cylinder is adjusted dependent on the estimated fuel puddle dynamics.

By implementing the essential structure just described, a more accurate fuel compensation approach for a spark ignition engine that accounts for time varying fuel injection dynamic behavior due to causes such as engine operating conditions, engine age, and fuel composition without requiring excessive computational resources can be constructed. The goals of this novel compensation approach are to reduce the normalized air/fuel ratio (lambda) deviations away from stoichiometry (lambda equals one) in the exhaust stream which occur during engine transients at both warm and cold engine operating conditions, using a computationally efficient approach that can be easily implemented, while achieving fast convergence by exploiting a model structure.

Before detailing specific structures for constructing a preferred embodiment a little theoretical background would be useful to fully appreciate the advantages and alternative structures.

Model Description

Figure 1:
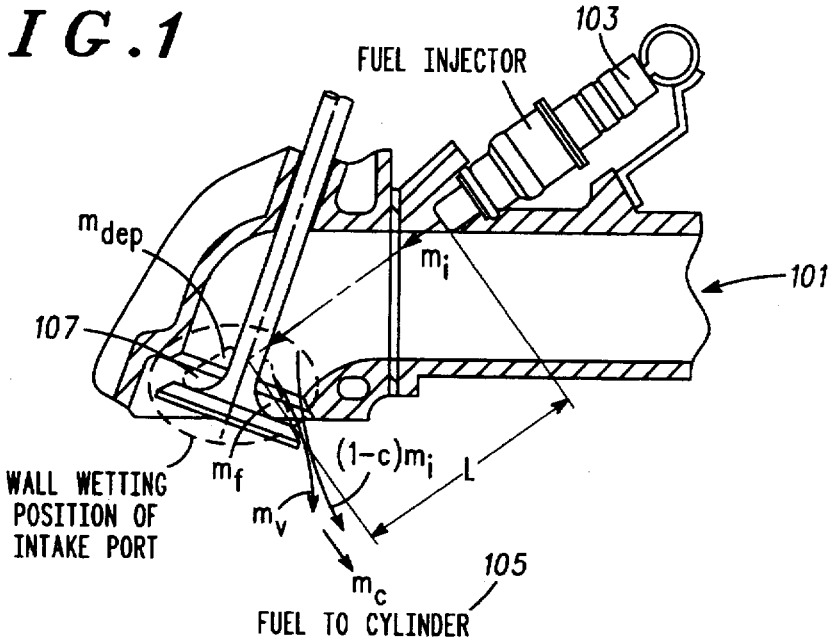
FIG. 1 is a schematic diagram of a fuel film (wall-wetting) model.

FIG. 1 is a schematic diagram of a fuel film (wall-wetting) model useful for representing an amount of fuel deposited, and a subsequent amount evaporated per engine cycle, on walls of an intake manifold and on intake valves of the engine. The illustrated model is characterized by two parameters, c and $b_v$. A parameter C denotes a fraction of fuel from a given fuel injection event that adheres to (puddles on) the manifold walls, intake valves, or other structure preventing the full fuel charge from reaching the cylinder's combustion chamber. Note that if c is equal to one, none of the fuel injected feeds through directly to the fuel charge in that cylinder for that engine cycle. A second parameter, $b_v$, denotes a mass fraction of the puddle that evaporates during a given engine cycle. The illustrated model has an advantage of being based in the crankshaft angle domain, which means that a sampling rate does not appear in the system dynamics.

Adaptive Feedforward Control Strategy

An essential approach of a control strategy employed here is adaptive feedforward control. By determining the appropriate wall-wetting parameters c and $b_v$ the effects of wall-wetting can be compensated for on-line. To accomplish on-line compensation, an amount of fuel injected is modified so as to compensate for the effects of wall-wetting on the combustion fuel charge, making it possible to maintain a stoichiometric air/fuel ratio in the cylinder for combustion even under transient engine operating conditions, unaffected by engine aging, fuel composition, and engine temperature. The identified gains can then be used to match the time varying engine dynamic behavior.

The wall-wetting compensation implementation taught here uses a feedforward compensation approach. The amount of desired fuel to match an estimated air charge is input to the compensation method to calculate an amount of fuel to inject to a cylinder in an immediate, proactive control action. Preferably, feedforward control is used for transient compensation, because the transport and sensing delays of the control system limit the bandwidth of the error-driven feedback loop, making adaptive cycle-by-cycle feedback compensation ineffective for fast transient changes in charge air mass.

The preferred approach identifies the evaporation wall-wetting parameter $b_v$ during periods of steady-state engine operation, including during cold run conditions. The preferred approach identifies the adhering (or puddling) wall-wetting parameter c during both steady-state and transient engine operating conditions, provided that the EGO sensor signal switches state at a sufficiently high frequency to enable accurate adaptation. Identification of the wall-wetting parameters is based only on the fuel injected, an air charge estimate, and an EGO (Exhaust Gas Oxygen) sensor reading.

The wall-wetting parameter estimate $\hat{b}_v$ is determined during steady-state engine operation by injecting a fuel or air identification signal of a known behavior into one or more cylinders of an engine. In the preferred embodiment the identification signal has a monotonic behavior. For instance, if at a steady state engine operating condition, the normalized fuel/air ratio is biased to a constant value (for example 0.95), the fuel injected, or alternatively airflow, is then temporarily biased to obtain another value on another side of stoichiometry (for example 1.05), by an identification signal with a monotonically increasing behavior. A temporal delay between the temporary injection of the identification signal and when the EGO switches state is then measured (typically in number of engine cycles). Alternatively, the temporal delay, or duration can be measured in terms of absolute time duration, in terms of accumulated engine degrees, or any other metric representative of a duration, or temporal delay, between the injected fuel charge and the switch in the EGO sensor state.

For a given identification signal and a resulting measured temporal delay, an estimate of the mass fraction of the puddle that evaporates during a given engine cycle $\hat{b}_v$ can be derived. The estimate of the mass fraction of the puddle that evaporates during a given engine cycle $\hat{b}_v$ can be derived based on an a priori-determined model, or as a function of engine temperature. The form of the resulting function is relatively simple, as the effects of fuel volatility and intake valve deposits diminish at low temperatures (i.e. as $b_v$ tends toward values less than 0.2).

The preferred approach identifies the adhering wall-wetting parameter c on every firing cycle, including during transients and during cold run conditions. Identification is based only on the fuel injected, an air charge estimate, a EGO (Exhaust Gas Oxygen) sensor reading and the estimate of the vaporization fraction, $\hat{b}_v$. An adhering parameter $\hat{c}$ identified by the algorithm during the previous engine cycle and the estimated fuel vaporization fraction $\hat{b}_v$ are used to predict the fuel burned during the next engine cycle, which is compared to the fuel burned based on the EGO sensor measurement. These are compared, and the result is used by the adaptation algorithm to update the adhering parameter estimate. The updated estimate is then used by a feedforward compensator to adaptively eliminate wall-wetting effects. This is shown schematically in FIG. 2, where the dotted line encloses the inventive structure. The adhering parmeter identification update equation is given by:

$$\hat{c}(k) = \hat{c}(k-1) + \frac{P_1(u(k-1)-u(k))*(\bar{y}(k)-h(k)\hat{p}(k-1))}{vP_1P_2 + P_1(u(k-1)-u(k))^2 + P_2(u(k-1)-y(k-1))^2}$$

where:

$$\bar{y}(k)=y(k)-y(k-1)+u(k-1)-u(k);\text{ and}$$

$$h(k)=[(u(k-1)-y(k-1))\ (u(k-1)-u(k))]$$

u(k)and y(k) are the mounts of fuel injected/burned at the k-th cycle, respectively, v, $P_1$ and $P_2$ are constants and k is the engine cycle index. The mount of fuel burned during the k-th cycle is modeled from the EGO sensor data as: $y(k)=1+\epsilon*\sin(\phi(k)-1)$, where $\phi$ is the exhaust fuel/air ratio and $\epsilon$ is a small positive constant.

Figure 2:
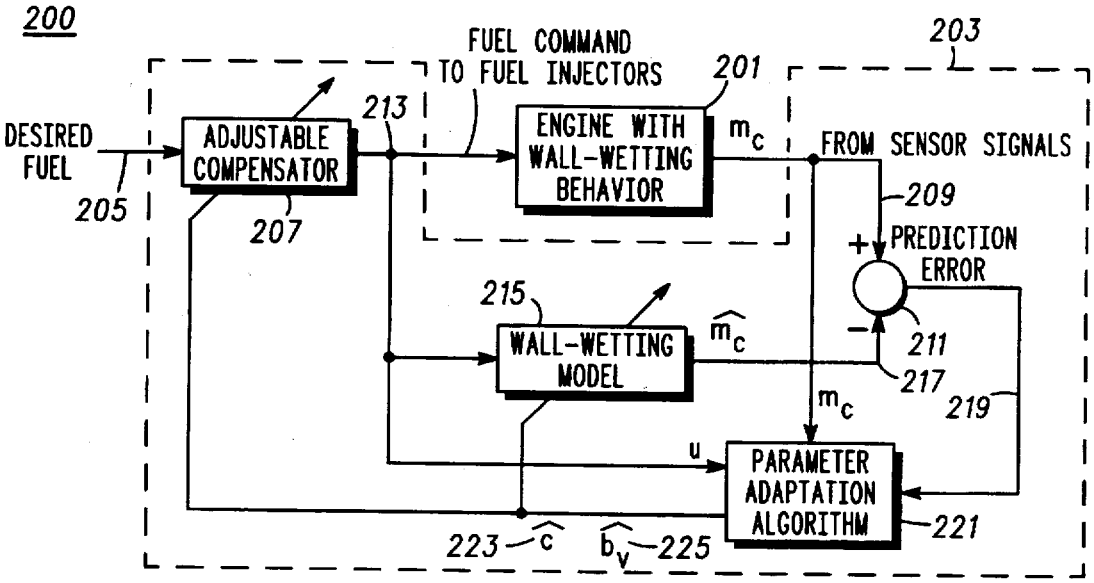
FIG. 2 is a schematic diagram of an adaptive controller in accordance with a preferred embodiment of the invention.

A schematic of the control system strategy is shown in FIG. 2. An adaptive controller 203 is characterized by three components, an adjustable compensator 207, a wall-wetting model 215, and a parameter adaptation algorithm 221. The adjustable compensator 207 receives a parmeter estimate $\hat{c}$ 223 and a parmeter estimate $\hat{b}_v$ 225 directly from the parmeter adaptation algorithm 221, and adjusts fuel injected 213 dependent on the parameter estimates 223 and 225 and a desired fuel demand 205.

The adjustable compensator 207 is a lead compensator 207, that cancels wall-wetting dynamics 201. The design of an adjustable wall-wetting compensator 207 is know to those of ordinary skill in the art and is not further discussed here, except in that the gains internal to the compensator 207 used to compensate for wall-wetting 201 are dependent on the estimates of the wall-wetting parameters 223 and 225.

The wall-wetting model 215 is used to estimate the value of the system output 209 based on the estimates 223 and 225, respectively of a parameter $\hat{c}$ from a previous engine cycle and of a parameter $\hat{b}_v$ from a vaporization fraction look-up table internal to the parameter adaptation algorithm 221. Alternatively, if the EGO sensor is not switching at an acceptable frequency (i.e. the exhaust gas has been rich or lean of stoichiometry for an extended period of time), the parameter estimate $\hat{c}$ may be provided by a adhering fraction look-up table internal to the parameter adaptation algorithm 221. The wall-wetting model 215 characteristic of the preferred embodiment of this invention is detailed in FIG. 1. Other wall-wetting models could be employed in similar fashion, including continuous time models, discrete models with varying sample rates, and continuous or discrete time models including higher order dynamic effects. The estimated value of the system output 217 is then subtracted from the measured system output 209 for the current cycle in order to obtain a prediction error 219. The prediction error 219 is then utilized by the parameter adaptation algorithm 221 in order to update the parameter estimate $\hat{c}$ 223 of a parameter c. The adhering parameter adaptation algorithm employed internal to the parameter adaptation algorithm 221 in the preferred embodiment of this invention is a recursive Linear Quadratic algorithm, but other identification algorithms based on Extended Kalman Filter Theory, H-Infinity, Neural Nets, Fuzzy Logic, or Nonquadratic Cost Functions could be similarly employed. The vaporization parameter adaptation algorithm internal to the parameter adaptation algorithm 221 consists of the steps of:

1) injecting an identifying fuel charge into the engine;
2) measuring a duration between when the identifying fuel charge is injected and when the EGO sensor switches state;
3) translating the duration measured in step 2 into an estimate of a quantity of fuel evaporated in a fuel intake system of the engine ($\hat{b}_v$) based on the phase shift observed between the injection of the identifying fuel charge and the output signal observed by the EGO sensor; and
4) storing this result as a function of the engine operating condition for use in cycle-by-cycle wall-wetting compensation.

Figure 3:
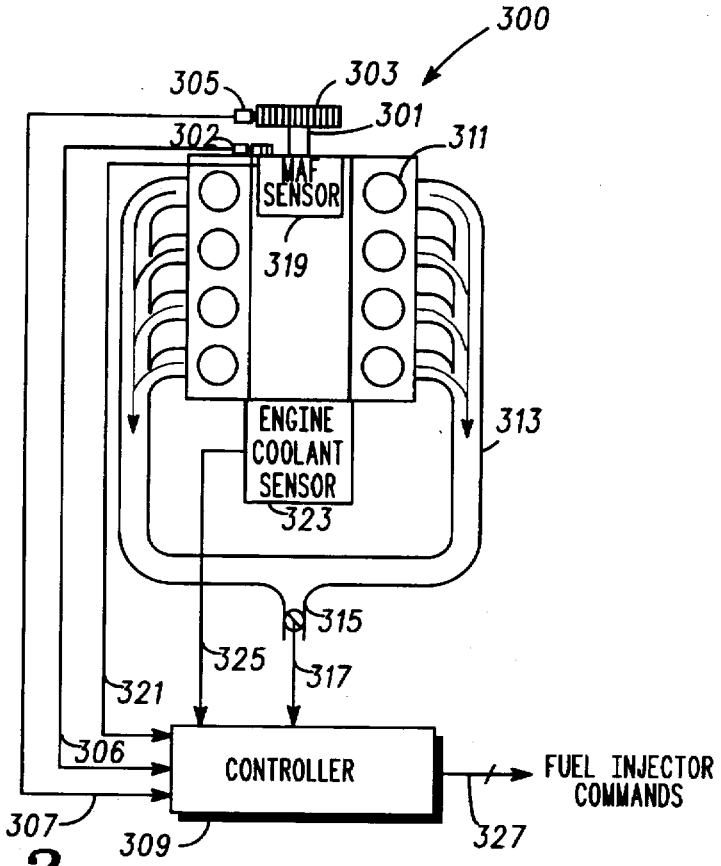
FIG. 3 is a hardware block diagram in accordance with the preferred embodiment of the invention.

FIG. 3 is a hardware block diagram for executing the preferred method steps. The system includes an engine 300 coupled to a crankshaft 301, coupled to a flywheel 303, which provides engine incremental position information 307 to a controller 309, via an encoder 305. Another encoder 302 is mounted in a position to sense camshaft rotation. The camshaft-positioned encoder 302 provides absolute engine position information 306 to the controller 309. Engine absolute position for each cylinder of the engine 300 can be derived in the controller 309 from the information 307 and 306, and is used by the controller 309 for synchronization of the preferred method. The controller is preferably constructed comprising a Motorola MC68332 microcontroller. The Motorola MC68332 microcontroller is programmed to execute the preferred method steps described later in the attached flow charts. Many other implementations are possible without departing from the essential teaching of this embodiment. For instance another microcontroller could be used. Additionally, a dedicated hardware circuit based control system, controlled in accordance with the teachings of this treatise, could be used for estimating fuel puddle dynamics, and a compensator could be used for adjusting fuel delivery.

Returning to FIG. 3, the engine 300 includes a cylinder 311, which through an exhaust manifold 313, drives a binary type oxygen sensor 315. Here, the sensor is an EGO or HEGO (Heated Exhaust Gas Oxygen) type sensor. The EGO sensor 315 is positioned downstream from an exhaust port of the cylinder 311 and measures a rich/lean characteristic from each of the cylinders of the engine 300. The EGO sensor 315 provides a signal 317, indicative of the measured rich/lean characteristic to the controller 309.

An mass-airflow rate (MAF) sensor 319 is coupled to an intake manifold of the engine 300. The air mass flowrate sensor 319 provides an output signal 321, indicative of air mass-flow rate into the engine's intake manifold, to the controller 309. The measured air mass-flow rate information is used to determine an air charge into the engine as well as a measure of load on the engine. Note that as alternative to employing a MAF sensor, a speed-density approach to determining intake air-mass charge could be implemented. This type of approach would use an intake air charge sensor—such as an absolute pressure sensor to measure intake manifold pressure, and an engine speed sensor for determining engine speed. An intake mass-flow rate or other air charge factor can then be calculated dependent on the determined engine speed and the intake manifold pressure. Note that the incremental position information 307 provided by the encoder 305 can be used as a speed signal indicative of rotational speed of the engine 300.

An engine coolant sensor 323 is thermally coupled to the engine 300, and outputs a signal 325 indicative of the engine's operating temperature.

The controller 309 has a bank of output signals 323 which are individually fed to fuel injectors associated with each cylinder of the engine 300.

As described earlier, the EGO sensor signal 317, the intake manifold mass air-flow signal 321, and a stored value of the injected fuel charge commanded by the controller (internal to the controller 309), are used to implement the preferred method.

Figure 4:
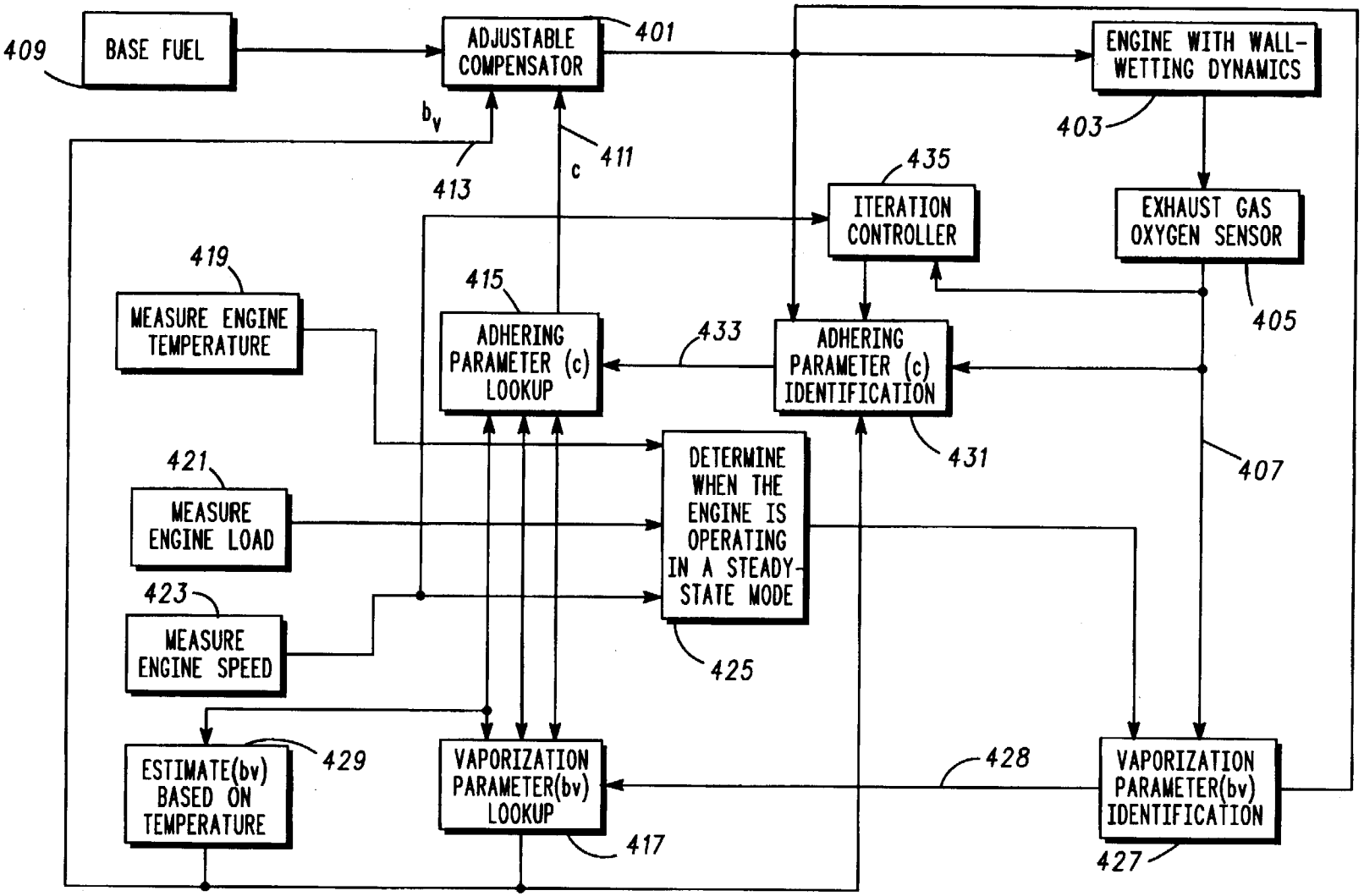
FIG. 4 is a flow chart introducing a method in accordance with the preferred embodiment of the invention.

FIG. 4 is a system block diagram. Essentially an adjustable compensator 401 is used to inject fuel into an engine 403 that has inherent wall-wetting dynamics described earlier. An exhaust gas oxygen sensor 405 is coupled to the engine. The exhaust gas oxygen sensor as described earlier is a binary type sensor, that outputs a signal 407 indicative of a rich or lean characteristic of gas exhausted from the engine.

In operation, a base fuel 409 is provided to the adjustable compensator 401 dependent on a demand from an operator of a vehicle in which the engine is functioning. The adjustable compensator 401 in turn causes fuel to be injected into the engine 403 dependent on the base fuel demanded, and determined wall-wetting parameter estimates $\hat{c}$ 411 and $\hat{b}_v$ 413 which are derived in the system shown here. While the engine 403 is operating in a non-steady state mode, that is during transient operation such as starting the engine, responding to an increased or decreased fuel demand, or other transient conditions where engine speed, engine load, or engine temperature are not approximately constant, the adjustable compensator 401 receives the wall-wetting parameter estimates $\hat{c}$ 411 and $\hat{b}_v$ 413 derived from lookup tables 415 and 417 respectively, which provide the parameters $\hat{c}$ 411 and $\hat{b}_v$ 413 based on a priori determined data.

Preferably, the estimates provided by the lookup tables are stored in a lookup table that is constructed during a calibration phase for an engine, or engine family, prior to end-user deployment. In the calibration phase the engine is controlled to map-out an a priori-determined model using a calibration technique commonly known to engine designers. The calibration technique stimulates the engine to operate over a wide range of engine speeds, engine loads, and engine operating temperatures, and from this procedure the designer can determine the wall-wetting parameters corresponding to a particular speed, load, temperature (or other variables indicative of engine operating condition) point. These base values of the wall-wetting parameters are then stored in lookup tables indexed by the variables chosen to represent engine operating condition (i.e. rpm, load, temperature).

Since the engine ages, the original map of the wall-wetting parameters will become inaccurate due to the effects of varying fuel volatility and engine intake valve deposits, making some sort of parameter identification necessary. In the preferred embodiment, the identified parameters are then stored in lookup tables 415 and 417 indexed by engine temperature 419, measured engine load 421, and measured engine speed 423.

Block 425 determines when the engine is operating in a steady-state mode. If the engine is operating in a steady-state mode, meaning that engine speed, engine load, and/or engine temperature are relatively constant, then a new vaporization parameter $\hat{b}_v$ is identified in block 427.

In block 427 a new vaporization fraction $\hat{b}_v$ is estimated by injecting a modulation signal of known frequency content (such as a sinusoid), and measuring the phase shift between the input signal and the output signal. This is accomplished by measuring the amount of time required from when the input signal crosses stoichiometry and when the EGO sensor switches state (indicating that the output signal has crossed stoichiometry). This time may be measured in engine cycles, engine degrees, absolute time, or any other metric indicative of a temporal duration without departing from the fundamental teaching of this embodiment. An estimate of the vaporization fraction $b_v$ can then be obtained, as this temporal delay is a strong function of the vaporization fraction $b_v$. The estimated value of the vaporization parameter $\hat{b}_v$ is then output from block 427 stored in lookup table 417 indexed by engine temperature 419, measured engine load 421, and measured engine speed 423.

In an alternative embodiment, the vaporization parameter bv is estimated based on temperature. This operation is shown in block 429.

The adhering parameter $\hat{c}$ is identified in block 431. Block 43 1 derives the adhering parameter $\hat{c}$ dependent on the vaporization parameter bv provided by either the vaporization parameter lookup table 417 or in the alternative embodiment the estimator shown in block 429. In block 431, a new estimate of the adhering wall-wetting parameter c is obtained. The preferred approach estimates the adhering wall-wetting parameter c on every firing cycle, including during transients and during cold run conditions. Identification is based only on the fuel injected, an air charge estimate, a EGO (Exhaust Gas Oxygen) sensor reading and the estimate of the vaporization fraction $\hat{b}_v$. The adhering parameter $\hat{c}$ identified by the algorithm during the previous engine cycle and the estimated fuel vaporization fraction $\hat{b}_v$ are used to predict the fuel burned during the next engine cycle, which is compared to the fuel burned based on the EGO sensor measurement. These are compared, and the result is used by the adaptation algorithm to update the adhering parameter estimate. The adhering parameter identification update equation is given by:

$$\hat{c}(k) = \hat{c}(k-1) + \frac{P_1(u(k-1)-u(k))*(\bar{y}(k)-h(k)\hat{p}(k-1))}{vP_1P_2+P_1(u(k-1)-u(k))^2+P_2(u(k-1)-y(k-1))^2}$$

where:

$$\bar{y}(k)=y(k)-y(k-1)+u(k-1)-u(k);\text{ and}$$

$$h(k)=[(u(k-1)-y(k-1))\ (u(k-1)-u(k))]$$

u(k)and y(k) are the amounts of fuel injected/burned at the k-th cycle, respectively, v, $P_1$ and $P_2$ are constants and k is the engine cycle index. The mount of fuel burned during the k-th cycle is modeled from the EGO sensor data as: $y(k)=1+\epsilon*\sin(\phi(k)-1)$, where $\phi$ is the exhaust fuel/air equivalence ratio and $\epsilon$ is a small positive constant. $\phi$ is defined as a ratio of the actual fuel/air mass ratio to the stoichiometric (chemically balanced) fuel/air ratio. This recursive process is suspended by the iteration controller 435 if the EGO sensor indicates a rich or lean condition for more than a predetermined number of engine cycles, as the EGO must switch to provide accurate information to the adaptation algorithm.

Once derived the new adhering parmeter estimate $\hat{c}$ is inserted into the adhering parmeter lookup table 415.

Figure 5:
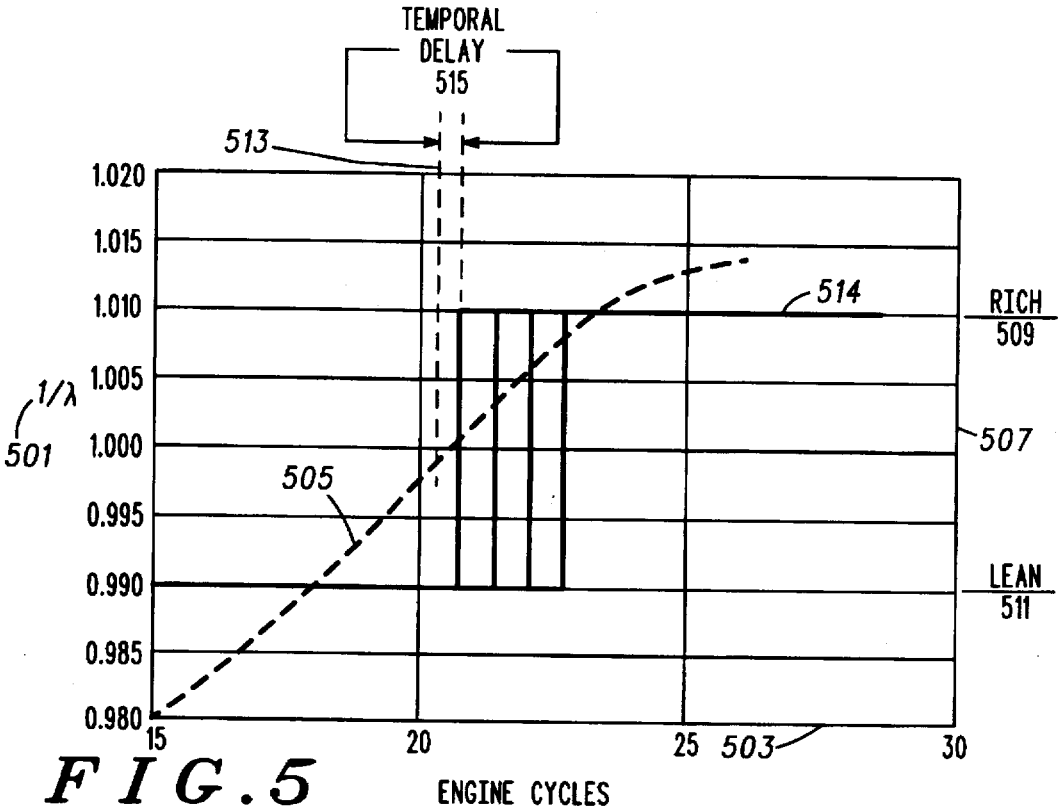
FIG. 5 is a chart showing temporal phase shifts between an input stimulus (injecting an identifying fuel charge into the engine) and an output reaction (exhaust gas oxygen sensor switching state) as a function of a fuel vaporization fraction.

FIG. 5 is a chart showing temporal phase shifts between an input stimulus and an output reaction as a function of a fuel vaporization fraction.

A y axis 501 indicates a rich-lean characteristic of fuel injected from the adjustable compensator into the engine, divided by the estimated air charge, resulting in an estimated fuel/air ratio and is expressed in terms of $\phi$(where $\phi$ is the normalized fuel/air equivalence ratio). The x axis represents a number of engine cycles, which is one technique for measuring the temporal delay, or duration described earlier. As described earlier, when the engine is operating is a steady state mode, the described system and method injects a monotonically increasing amount of fuel illustrated here as the dash line 505. In the preferred embodiment the modulation signal is a sinusoid of a predetermined frequency, said predetermined frequency being chosen for the visibility of variations in the vaporization fraction.

Another y axis 507 indicates the two possible states output from the exhaust gas oxygen sensor that being either a rich state 509 or a lean state 511.

At the point where the input signal 505 crosses stoichiometry ($\phi$ equals one) 513, the number of engine cycles occurring is counted until the EGO sensor signal 514 makes a corresponding change in state from lean 511 to rich 509. The counted number of engine cycles is the measurement of the phase shift (temporal delay 515) between the input signal 505 and when the corresponding EGO signal 514 switches state from lean 511 to rich 509. The vertical transitions in the EGO sensor signal 514 shown in FIG. 5 correspond to different values of the vaporization parameter by. Hence, the value of the temporal delay 515 determines the estimate of the vaporization fraction $\hat{b}_v$.

Note that in the above discussion, identification fuel charges were injected into the engine with no mention of individual cylinders. The described approach can also be used to identify the wall-wetting performance of individual cylinders as well.

In conclusion, the described approach actively compensates for changing wall-wetting parameters while an engine is operating in an end-user mission. This technique results in improved transient and cold engine performance, particularly as the engine ages, and while fuel composition changes. The described system uses an EGO sensor which keeps system complexity down and cost in control.

What is claimed is:

1. A method of adaptive transient fuel compensation for an engine comprising the steps of:

injecting an identifying fuel charge into the engine;

measuring a duration between when the identifying fuel charge is injected in the step of injecting, and when a binary-type exhaust gas oxygen sensor switches state;

translating the duration measured in the step of measuring a duration, into an estimate of a fraction of fuel evaporated in a fuel intake system of the engine ($b_v$);

estimating a fraction of fuel adhering to the fuel intake system of the engine (c) dependent on the ($b_v$) determined in the step of translating; and adjusting a base fuel charge to the engine, dependent on the ($b_v$) determined in the step of translating and the (c) determined in the step of estimating.

2. A method in accordance with claim 1 wherein the step of measuring a duration comprises a step of:

counting a number of engine cycles occurring between when the identifying fuel charge is injected in the step of injecting an identifying fuel charge and when the binary-type exhaust gas oxygen sensor switches state.

3. A method in accordance with claim 1 wherein the step of measuring a duration comprises a step of:

measuring a time difference between when the identifying fuel charge is injected in the step of injecting and when the binary-type exhaust gas oxygen sensor switches state.

4. A method in accordance with claim 1 wherein the step of estimating (c) comprises a step of:

estimating (c) in accordance with the following relationship:

$$\hat{c}(k) = \hat{c}(k-1) + \frac{P_1(u(k-1)-u(k))*(\bar{y}(k)-h(k)\hat{p}(k-1))}{vP_1P_2+P_1(u(k-1)-u(k))^2+P_2(u(k-1)-y(k-1))^2}$$

where:

$$\bar{y}(k)=y(k)-y(k-1)+u(k-1)-u(k);$$

$$h(k)=[(u(k-1)-y(k-1))\ (u(k-1)-u(k))];\text{ and}$$

u(k)and y(k) are the mounts of fuel injected/burned at the k-th cycle, respectively, v, $P_1$ and $P_2$ are constants and k is the engine cycle index.

5. A method in accordance with claim 1 wherein the step of injecting an identifying fuel charge into the engine comprises a step of:

injecting an identifying fuel charge into one cylinder of the engine over more than one engine cycle, wherein an amount of the identifying fuel charge injected in successive engine cycles changes monotonically.

6. A method in accordance with claim 5 wherein the monotonically changing identifying fuel charge injected in successive engine cycles follows a sinusoid behavior.

7. A method in accordance with claim 1 wherein the step of injecting an identifying fuel charge into the engine comprises a step of:

injecting an identifying fuel charge into more than one successively firing cylinders, wherein an amount of the identifying fuel charge injected in successive engine cycles changes monotonically.

8. A method in accordance with claim 7 wherein the monotonically changing identifying fuel charge injected in successive engine cycles follows a sinusoid behavior.

9. A method of adaptive transient fuel compensation for a cylinder in a engine comprising the steps of:

generating a base fuel charge signal;

generating an identifying fuel charge signal;

combining a base fuel charge signal and the identifying fuel charge signal and injecting a combined fuel charge into the engine responsive to the combined signal;

measuring a temporal delay between when the combined fuel charge is injected in the step of combining and injecting and when a binary-type exhaust gas oxygen sensor switches state; and adjusting the base fuel charge signal, dependent on the temporal delay measured in the step of measuring.

10. A method in accordance with claim 9 wherein the step of measuring a duration comprises a step of:

counting a number of engine cycles occurring between when the identifying fuel charge is injected in the step of injecting an identifying fuel charge and when the binary-type exhaust gas oxygen sensor switches state.

11. A method in accordance with claim 9 wherein the step of measuring a duration comprises a step of:

measuring a time difference between when the identifying fuel charge is injected in the step of injecting and when the binary-type exhaust gas oxygen sensor switches state.

12. A method in accordance with claim 9 wherein the step of estimating (c) comprises a step of:

estimating (c) in accordance with the following relationship:

$$\hat{c}(k) = \hat{c}(k-1) + \frac{P_1(u(k-1)-u(k))*(\bar{y}(k)-h(k)\hat{p}(k-1))}{vP_1P_2+P_1(u(k-1)-u(k))^2+P_2(u(k-1)-y(k-1))^2}$$

where:

$$\bar{y}(k)=y(k)-y(k-1)+u(k-1)-u(k);$$

$$h(k)=[(u(k-1)-y(k-1))\ (u(k-1)-u(k))];\text{ and}$$

u(k)and y(k) are the mounts of fuel injected/burned at the k-th cycle, respectively, v, $P_1$ and $P_2$ are constants and k is the engine cycle index.

13. A method in accordance with claim 12 wherein the step of injecting an identifying fuel charge into the engine comprises a step of:

injecting an identifying fuel charge into one cylinder of the engine over more than one engine cycle, wherein an amount of the identifying fuel charge injected in successive engine cycles changes monotonically.

14. A method in accordance with claim 13 wherein the monotonically changing identifying fuel charge injected in successive engine cycles follows a sinusoid behavior.

15. A method in accordance with claim 12 wherein the step of injecting an identifying fuel charge into the engine comprises a step of:

injecting an identifying fuel charge into more than one successively firing cylinders, wherein an amount of the identifying fuel charge injected in successive engine cycles changes monotonically.

16. A method in accordance with claim 15 wherein the monotonically changing identifying fuel charge injected in successive engine cycles follows a sinusoid behavior.

17. A system of adaptive transient fuel compensation for an engine comprising:

means for generating a base fuel charge signal;

means for generating an identifying fuel charge signal;

means for combining a base fuel charge signal and the identifying fuel charge signal and injecting a combined fuel charge into the engine responsive to the combined signal;

means for measuring a temporal delay between when the combined fuel charge is injected by the means for combining and injecting and when a binary-type exhaust gas oxygen sensor switches state;

means for translating the duration measured by the means for measuring, into an estimate of a quantity of fuel evaporated in a fuel intake system of the engine ($b_v$);

means for estimating a quantity of fuel adhering to the fuel intake system of the engine (c) dependent on the ($b_v$); and means for adjusting the base fuel charge signal, dependent on the ($b_v$) and (c) determined by the means for translating, and means for estimating respectively.

* * * * *

UNITED STATES PATENT AND TRADEMARK OFFICE

CERTIFICATE OF CORRECTION

PATENT NO. : 5,690,087

DATED : November 25, 1997

INVENTOR(S) : Schumacher et al.

It is certified that error appears in the above-indentified patent and that said Letters Patent is hereby corrected as shown below:

In claim 4, col. 9, line 23, the word "mounts" should be --amounts--.

In claim 12, col. 10, line 21, the word "mounts" should be --amounts--.

Signed and Sealed this

Eighth Day of September, 1998

*Attest:*

*Attesting Officer*

Bruce Lehman

BRUCE LEHMAN

*Commissioner of Patents and Trademarks*